United States Patent [19]

Bradley

[11] 4,239,308

[45] Dec. 16, 1980

[54] DISPLAY TRAY ASSEMBLY

[76] Inventor: Paul W. Bradley, 3740 Sioux Ave., San Diego, Calif. 92117

[21] Appl. No.: 25,281

[22] Filed: Mar. 29, 1979

[51] Int. Cl.[3] ..... A47B 47/00

[52] U.S. Cl. ..... 312/201; 312/226; 312/300

[58] Field of Search ..... 312/135, 201, 202, 226, 312/300, 302, 305, 308, 324; 220/4

[56] References Cited

U.S. PATENT DOCUMENTS

| | | | |
|---|---|---|---|
| 2,136,843 | 11/1938 | Dinkel | 312/201 |
| 2,775,498 | 12/1956 | Geltel | 312/324 |
| 2,795,473 | 6/1957 | Smith | 312/295 |
| 3,202,470 | 8/1965 | Lage | 312/324 |

*Primary Examiner*—Casmir A. Nunberg
*Attorney, Agent, or Firm*—Brown & Martin

[57] ABSTRACT

Pivoting trays are carried on pivot posts. The trays include a storage recess in their upper surface. When the trays are pivoted from a stowed to an open position, the contents of the trays become visible and accessible. Storage recesses are also provided in the base and top members. Compartmented inserts from the storage recess into a selectable number of compartments are carried in the trays and are removable from the trays in their opened position.

6 Claims, 5 Drawing Figures

DISPLAY TRAY ASSEMBLY

BACKGROUND OF THE INVENTION

It is common for a women to own numerous individual items of jewelry and costume jewelry. Such jewelry is stored in a variety of places within the home and transported in a variety of enclosures for travel. It is desirable that the owner have substantially all of the jewelry in one place and easily accessible so that the owner may select from amongst all of the items of jewelry which complement one another and any items of clothing selected. However, frequently when traveling, and even in the home, it has not been possible to store all of the items of jewelry in one location, so that the owner must select, in part from memory, from the different items of jewelry owned and then search out the location for the particular item of jewelry.

Conventional jewelry boxes are utilized by many women to partially solve the problems of a common storage location and accessibility. Conventional jewelry boxes may comprise a plurality of drawers. In searching for a particular item of jewelry, the owner must open each of the drawers. Even with the drawer opened to its fullest extent, the jewelry at the extreme rear of the drawer is not easily visible or accessible. Then for the jewelry in the next drawer to be inspected, the first drawer must be closed. As a result, even with the best of conventionally available jewelry boxes, it is not possible for the owner to view the entire jewelry collection at one time. Further, such jewelry boxes are not sufficiently rugged to be taken as, or in, luggage.

The ability to view and store a large number of articles of jewelry or similar small articles is also present in many other environments, including retail stores and similar establishments.

Accordingly, it is desirable to have a display device which is capable of simultaneously displaying a large number of stored articles. Such a display device is particularly desirable if a large number of jewelry articles may be simultaneously displayed and subsequently stored.

SUMMARY OF THE INVENTION

According to an exemplary embodiment of the invention, the disadvantages of prior art display devices are overcome in a display tray assembly. The articles are displayed in compartment trays which pivot from a stowed position to a display position. In the stowed position, the trays nest vertically to occupy a minimum of space to make a structurally-strong package. The trays are supported vertically, and for pivoting rotation, between the stowed and displayed position on pivot posts. At least two pivot posts are required. However, in the exemplary embodiment, a third post, a support post, is utilized. The pivot posts and support posts connect between a base member and top member. The base and top members also include recesses in their upper surface for receiving and displaying articles. The base and upper members are made horizontally coextensive with the pivoting trays to produce a uniform exterior appearance. A lid is provided to cover the top member and further serves as a mirror mount. The mirror is carried in a recess on the inner recess surface of the lid and pivots between closed and open positions. A stop member integral with the top member holds the mirror at an optimum level for display of the articles in the top member and for normal uses of a mirror in fitting the jewelry.

It is therefore an object of the invention to provide a new and improved display assembly. As described in connection with the exemplary embodiment, the objects are achieved by providing a plurality of pivoting trays which in their open position provide for an inspection of and selection of all of the stored articles. In their stowed position, the unit provides a rigidity and strength wherein the pivoting trays cooperate with the base and top members to form a functionally integral unit. Since the several parts of the device need be interconnected only by the several posts, the manufacture, assembly and reconfiguration of the apparatus is facilitated.

DETAILED DESCRIPTION OF THE DRAWINGS

Figure 1:
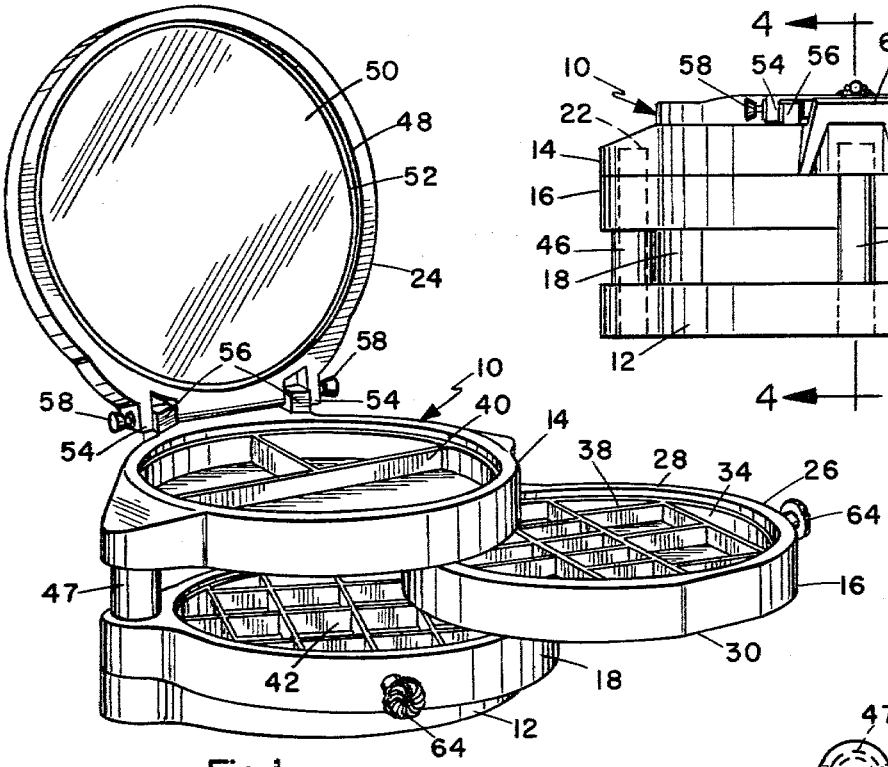
FIG. 1 is a perspective view of the display tray assembly, with the pivoting trays and lid open.

Referring now to the drawings, there is illustrated a display tray assembly 10 according to the invention. The assembly includes a generally circular base member 12 and top member 14 shown utilized with two pivoting tray members 16 and 18. The top and bottom members together with the pivoting trays are interconnected by pivot posts 20 and 22 which terminate in the base and top members and are received in circular openings through the pivoting tray members. The lowermost pivoting tray is supported directly on the base 12. To maintain the uppermost pivoting tray 16, in vertical position, a spacer 46 is applied over the pivot post 22 so that the pivoting tray 16 is received over the post 22 and verticially supported by the spacer 46. A similar spacer 47 on the post 20 spaces tray 18 from top member 14. The pivot posts may be secured in position by removable fasteners (not shown), so that the pivot posts may be removed and replaced by a longer pivot post thereby making room for additional pivoting trays. Such additional pivoting trays would be mounted on alternate pivot posts and spaced vertically by spacers corresponding to the spacer 46. At the rear of the assembly, a third post is provided. This support post 62 does not carry any of the trays and connects directly between the base and top members thereby adding additional strength to the assembly.

A lid 24 is carried on the top member 14 and has a generally circular configuration corresponding to the base tray members and top members. The lid is carried on the top member by a hinge assembly comprising lid lugs 56 which cooperate with top member lugs 54 and hinge pins 58 to provide a pivoting/hinging relationship so that the lid may be pivoted between a closed position as illustrated in full lines in FIG. 4, and the open position illustrated by the broken lines in FIG. 4. The limit of the open position is controlled by an integral stop member 60 formed into the top member 14. The interior surface of the lid is provided with a recess 48 into which is received a mirror 50 of corresponding configuration.

The mirror is retained in the recess by a ring member 52.

Referring specifically to the pivoting tray 16, the tray incorporates a generally ring-shaped wall member 26 having planar upper and lower surfaces 28 and 30 respectively. The planar upper and lower surfaces makes it possible for an individual tray member to be pivoted from the closed to the open position without interferring with other trays or the base and top members. Adjacent to the lower surface 30, an interior flange 32 is provided. The flange 32 provides a shelf on which the compartmented insert 34 rests.

Insert 34 is formed from a unitary piece of plastic sheet material by a suitable forming process such as vacuum forming. Relatively thin plastic sheet material may be utilized because of the additional stiffness provided by the forming of the material into a plurality of dividers, such as the typical divider 38. The entire insert 34 rests at its perpherial edge on the flange 32. Because the insert portion of the tray is readily removable, the jewelry articles contained in the insert may be withdrawn from the assembly for closer inspection, sorting, or similar purposes. In addition, it is possible to exchange or replace the inserts with inserts having a different number of dividers. For maximum protection of the jewelry as well as appearance, the plastic sheet material may be provided with a felt flocking.

The range of variations of the inserts is suggested by the inserts 40, 42 and 44. Insert 40 has only three compartments and therefore could be utilized for the largest items stored. The insert 40 is shown as being received within the top member 14 which is similarly configured to the pivoting trays and has a flange 41 to support the insert. Insert 44 is received in the base member and carried on a flange 45. Insert 42 has the largest number of compartments for storage of the smallest articles and is received within the tray 16.

Figure 2:
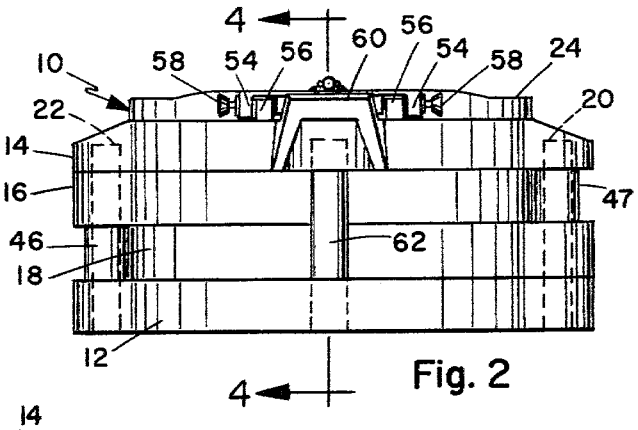
FIG. 2 is a rear elevation view of the closed assembly.
Figure 5:
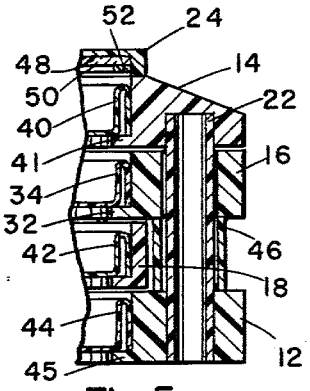
FIG. 5 is a sectional view taken on line 5—5 of FIG. 4.
Figure 3:
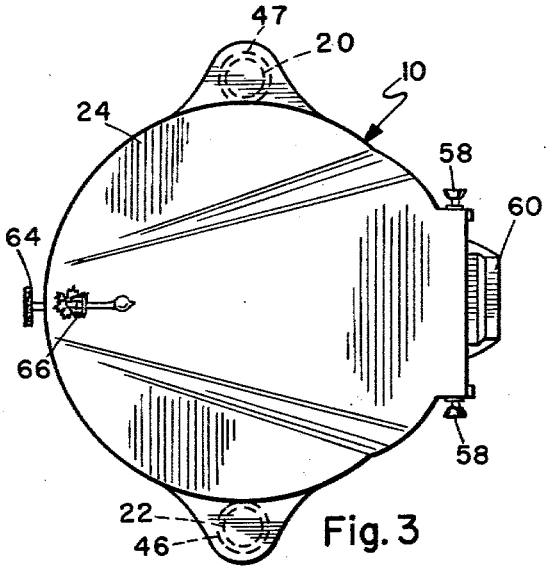
FIG. 3 is a top plan view of the closed assembly.
Figure 4:
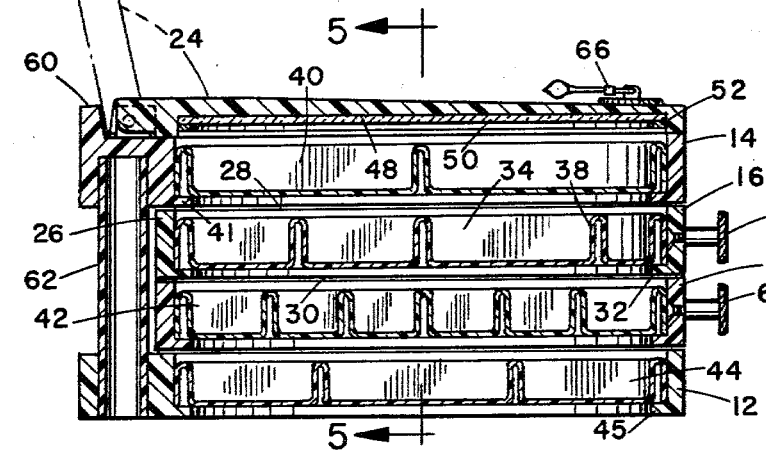
FIG. 4 is an enlarged sectional view taken on line 4—4 of FIG. 2.

The assembly will normally be stored with all of the trays in their stowed position, corresponding to that illustrated in FIGS. 2 and 3, and with the lid lowered as shown in full lines in FIG. 4. To inspect the contents, the user moves the trays by grasping handle members 64 from the stowed to the opened position. In FIG. 1, for purposes of illustration, the trays are shown only partly opened. However, since the trays are restrained in pivoting only by the support pivot 62, the trays may be pivoted through nearly a full circle. Only when the trays interfer with the fixed support, would further pivoting be blocked. Because of the range of movement possible, these trays may then be extended beyond 90° so that the contents are fully visible. With all of the trays pivoted, so that they do not interfer with one another, and so that they are clear of the area between the pivot posts 20 and 22, the contents of the base member insert 44 also become visible. Finally, the contents of the top member insert 40 become visible by opening the lid 24 with the handle 66 provided.

Having described my invention, I now claim:

1. A display tray assembly comprising:

a base, at least two pivot posts adapted to be secured to and extend upwardly from said base, at least two pivoting trays, a first of said pivoting trays adapted for being supported on a first of said posts, a second of said pivoting trays adapted for being supported by a second of said posts, said pivoting trays comprising a generally ring-shaped wall supporting a removable tray and having a plurality of storage compartments, said pivot post comprising means for supporting said pivoting trays at a predetermined height, and for supporting said trays for pivoting movement from a position between said pivot posts, and a position at least 90° from a line connecting said pivot posts.

2. The display tray assembly of claim 1, further including a top member for being fixed to at least two of said pivot posts, a generally planar lid assembly for being pivotally secured to the edge of said top tray and for movement between stowed and open positions, a mirror secured in a generally circular recess of said lid and retained by a generally circular retaining ring.

3. The display tray assembly according to claim 1 wherein:

said ring member includes a horizontally extending flange along the lower edge of said generally ring-shaped wall for supporting said compartmented tray.

4. The display tray assembly according to claim 1 wherein:

said base comprises a generally planar horizontally extending member incorporating a storage recess in the upper surface of said base.

5. The display tray assembly according to claim 2 wherein:

said top includes a stop member for limiting the open position of said lid.

6. The display tray assembly according to claim 1 wherein:

said compartment insert comprises a unitary piece of sheet material formed into a generally circular configuration with at least one upright wall dividing said insert into a plurality of compartments, said generally circular insert being sized for being supported from said flange.

* * * * *